US005477725A

United States Patent [19]

Müller

[11] Patent Number: 5,477,725

[45] Date of Patent: Dec. 26, 1995

[54] ARTICULATED LEVER PRESS

[75] Inventor: Siegfried Müller, Olpe, Germany

[73] Assignee: Lehnhauser Hammerwerk GmbH, Germany

[21] Appl. No.: 211,348

[22] PCT Filed: Jul. 21, 1993

[86] PCT No.: PCT/EP93/01930

§ 371 Date: Jul. 11, 1994

§ 102(e) Date: Jul. 11, 1994

[87] PCT Pub. No.: WO94/02308

PCT Pub. Date: Feb. 3, 1994

[30] Foreign Application Priority Data

Jul. 23, 1992 [DE] Germany ..... 42 24 277.0

[51] Int. Cl.[6] ..... B21J 15/26; B21J 9/18

[52] U.S. Cl. ..... 72/450; 72/456

[58] Field of Search ..... 72/450, 451, 453.03, 72/455, 456

[56] References Cited

U.S. PATENT DOCUMENTS

| | | | |
|---|---|---|---|
| 2,105,053 | 1/1938 | Patrick . | |
| 2,204,413 | 6/1940 | Hubbert . | |
| 2,916,987 | 12/1959 | Hanni . | |
| 4,916,932 | 4/1990 | Obrecht et al. | 72/450 |

FOREIGN PATENT DOCUMENTS

| | | | |
|---|---|---|---|
| 393278 | 8/1908 | France . | |
| 2530166 | 1/1984 | France . | |
| 862289 | 1/1953 | Germany . | |
| 2442433 | 1/1976 | Germany | 72/456 |
| 3137799 | 4/1983 | Germany . | |
| 3146174 | 5/1983 | Germany . | |
| 0387312 | 4/1931 | United Kingdom | 72/456 |
| 2103523 | 2/1983 | United Kingdom . | |

*Primary Examiner*—David Jones
*Attorney, Agent, or Firm*—Henry M. Feiereisen

[57] ABSTRACT

The press has a basically C-shaped frame with a base plate (10), table (13), two side cheeks (11), and a head plate (12). A guiding body (20) which is arranged on the table between the two side walls without connection with the column cheeks loaded by the pressing force or with the upper part of the press is provided for guiding the box-shaped slide (30). The pressing force is initiated by a pressure-medium cylinder on the head plate. The piston rod (47) of the pressure-medium cylinder is coupled with two articulated levers (60) which are connected in turn at a side cheek (11) via guide rods (43). The two driving levers (60) are connected with the slide via two connecting rods (40). A column damping arrangement with two columns (50) has an upper part (52) connected with the cover plate, a lower part connected with the table, and a damping cylinder piston (51) acting therebetween. In the case of an off-center loading in the longitudinal direction of the slide, a one-sided expansion of the die space is compensated for by displacement of the upper part of the press.

6 Claims, 5 Drawing Sheets

ARTICULATED LEVER PRESS

The object of the invention consists in the structural design of an articulated lever press which may be applied in the most versatile manner, in principle, in the field of non-cutting metal shaping.

This object is met by an articulated lever press with the features of the main claim. The subclaims contain preferred constructions and alternative solutions.

The articulated lever press, according to the invention, has a straight-sided or double-column type C-shaped frame, known per se. A base guiding body is arranged between the two column cheeks and forms a unit with the base of the press. However, there is not normally a connection between the guiding body, the column cheeks loaded by the pressing force, and the upper part of the press. If the column is shifted due to the pressing force and reaction forces, the guidance, which is separate from the column, remains unaffected.

The guide may be constructed as a wrap-around six-way flat guide in which each guideway guides the ram or slide in only one direction and is free in the other direction. Accordingly, e.g. in the event of heating and the enlargement resulting therefrom, the slide is always guided accurately without jamming.

The guideways for guiding the slide are so designed that the space above the press table is not limited by projecting guide parts. This is advantageous in that parts of the tool or die projecting beyond the surface of the slide do not restrict the lift or travel of the slide or substantially reduce the guideways so as to negatively affect the guidance characteristics. According to the invention, the slide is guided along the full height of the slide surface in every case.

Further, the slide guidance can also be continued below the slide surface.

The slide is driven by a combined articulated lever function and lever function, wherein these two functions can run consecutively with respect to time. During the closing movement, the articulated lever function occurs first. When the articulated lever achieves an approximately extended position, it no longer generates travel as the transmission ratio approaches infinity. In this situation, the lever takes over for the rest of the nominal force path. This is carried out with a constant transmission ratio and is determined by the position of the lever around the horizontal. The possible swivel angle prior to and subsequent to the horizontal position is approximately 20°. The angular position is determined by the task at hand. With small nominal force paths, an eccentric lever may also be used instead of a lever.

An overload protection, such as is often required in mechanical presses with alternating transmission ratio according to the prior art, generally need not be installed in a press according to the invention. In the latter case, the transmission ratio remains constant in the nominal force range. The maximum force is determined by the force of the pressure-medium cylinder. The pressure medium is adjusted to the maximum system pressure by means of a pressure limiting valve. The maximum slide force is likewise determined in this way. Accordingly, in view of the absence of failure protection, a weakest point of the slide drive is established. The arrangement of a vertical pressure-medium cylinder in combination with the kinematics of the articulated lever drive makes possible within a confined space a mechanical drive allowing lift paths of more than 300 mm with a large nominal force path of up to approximately 100 mm at the same time.

The column damping arrangement, according to the invention, has a pressure piston and a pressure-medium cylinder with associated valves and supply storages. Operation of the column damping arrangement is initiated by the springing of the columns under load. The pressure piston is still not loaded at this time. Between the loaded column and the unloaded pressure piston there occurs a movement which allows pressure medium to flow from a supply storage into the mounted or fitted cylinder. For example, if the load is suddenly removed from the column after a cutting process, the pressure medium which is under pressure can escape only via a valve due to the connection. The column reduces the stored tension in a controlled manner.

No additional energy is required for damping the column. It is even possible in individual cases to recover the springing energy. In the case of an off-center loading in the longitudinal direction of the slide, the base guiding body, which is oriented exclusively to the base of the press, in combination with the articulated lever drive described above compensates for the one-sided expansion of the die space by means of a displacement of the upper part of the press.

In an articulated lever press according to the invention (C-frame press), a two-point bearing or multiple-point bearing of the slide in connection with a slide guide which is separate from the column and in connection with a specific drive system results in a compulsory, active compensation of tilting and shifting of the slide. Because of the shifting of the guide and column resulting therefrom, the die space remains automatically active and parallel exclusively due to inherent kinematics.

An embodiment example of the invention is described in the following with reference to the accompanying drawings.

Figure 1:
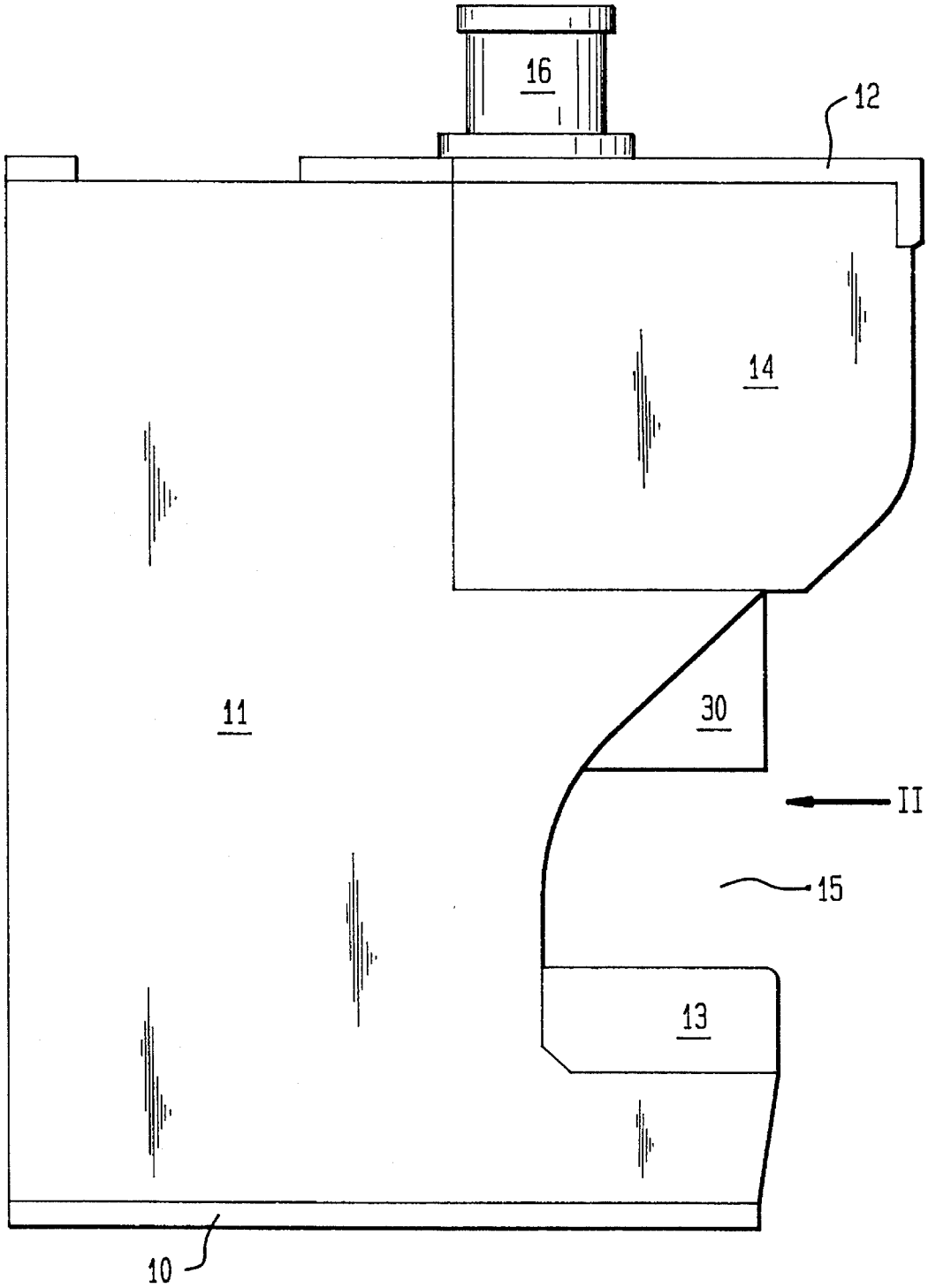
FIG. 1 shows a side view of an articulated lever press according to the invention.
Figure 2:
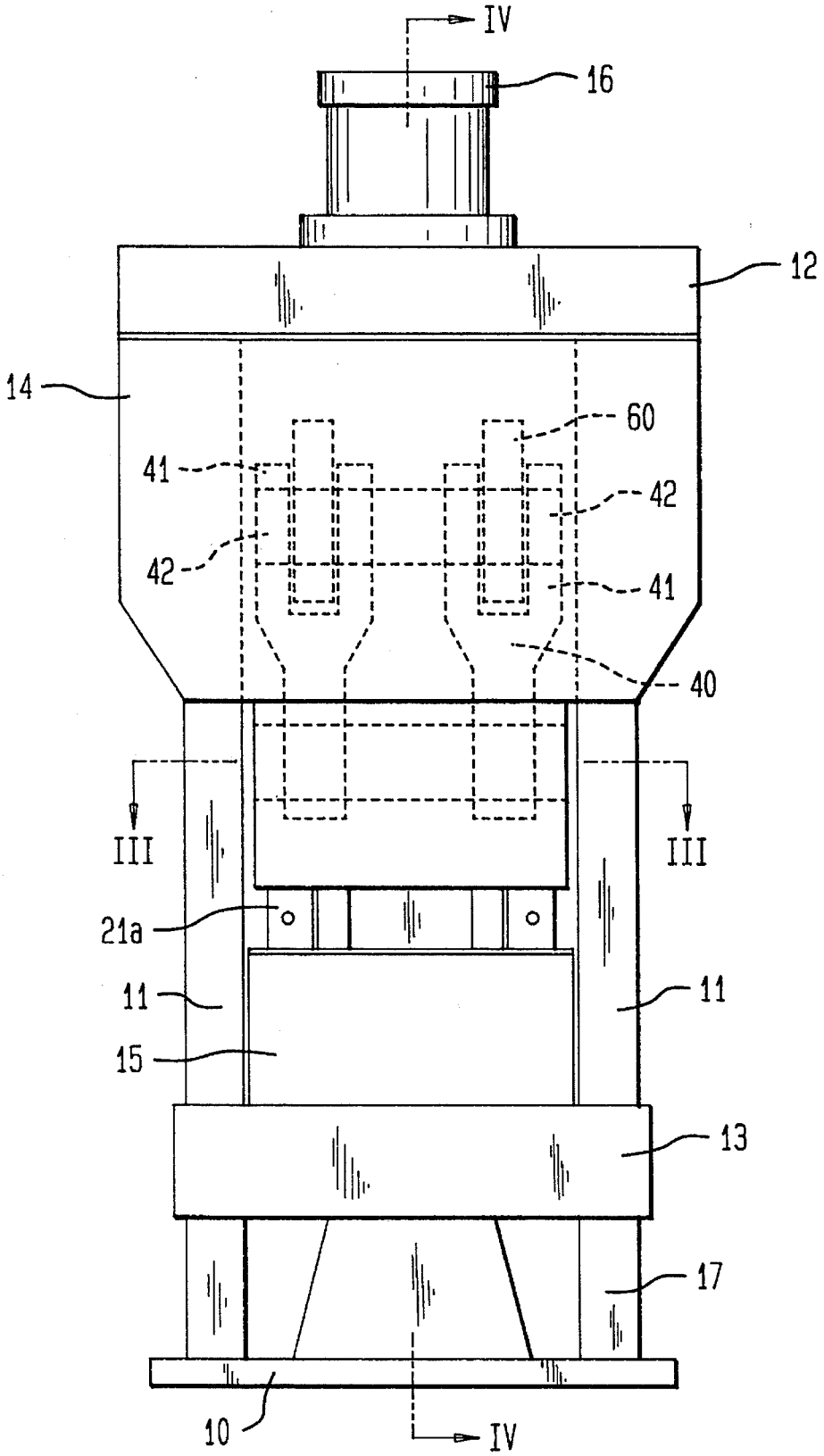
FIG. 2 shows a view from the front.

Referring first to FIGS. 1 and 2, the articulated lever press according to the invention has a frame formed by a base plate 10, two side walls 11 (cheeks), a head plate 12, and a table 13. Located above the head plate is a pressure-medium cylinder 16 by means of which a box-shaped slide 30 is moved downward against the table 13 and then moved back again in order to a carry out a pressing process. In the region of the table 13 and slide or ram 30, the side walls 11 are cut away, resulting in a work space 15 which is accessible from three sides. The table is stably supported on feet 17. The frame has a cover 14 over the work space and, considered in its entirety, is constructed as a C-column.

Figure 3:
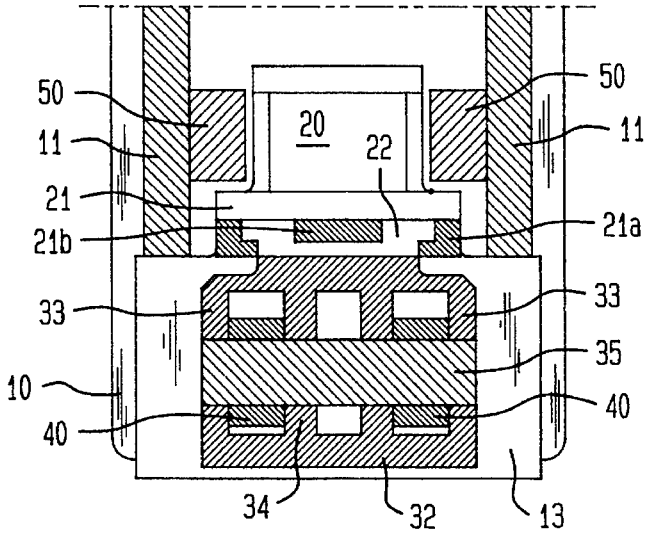
FIG. 3 shows a section according to III—III of FIG. 2.
Figure 4:
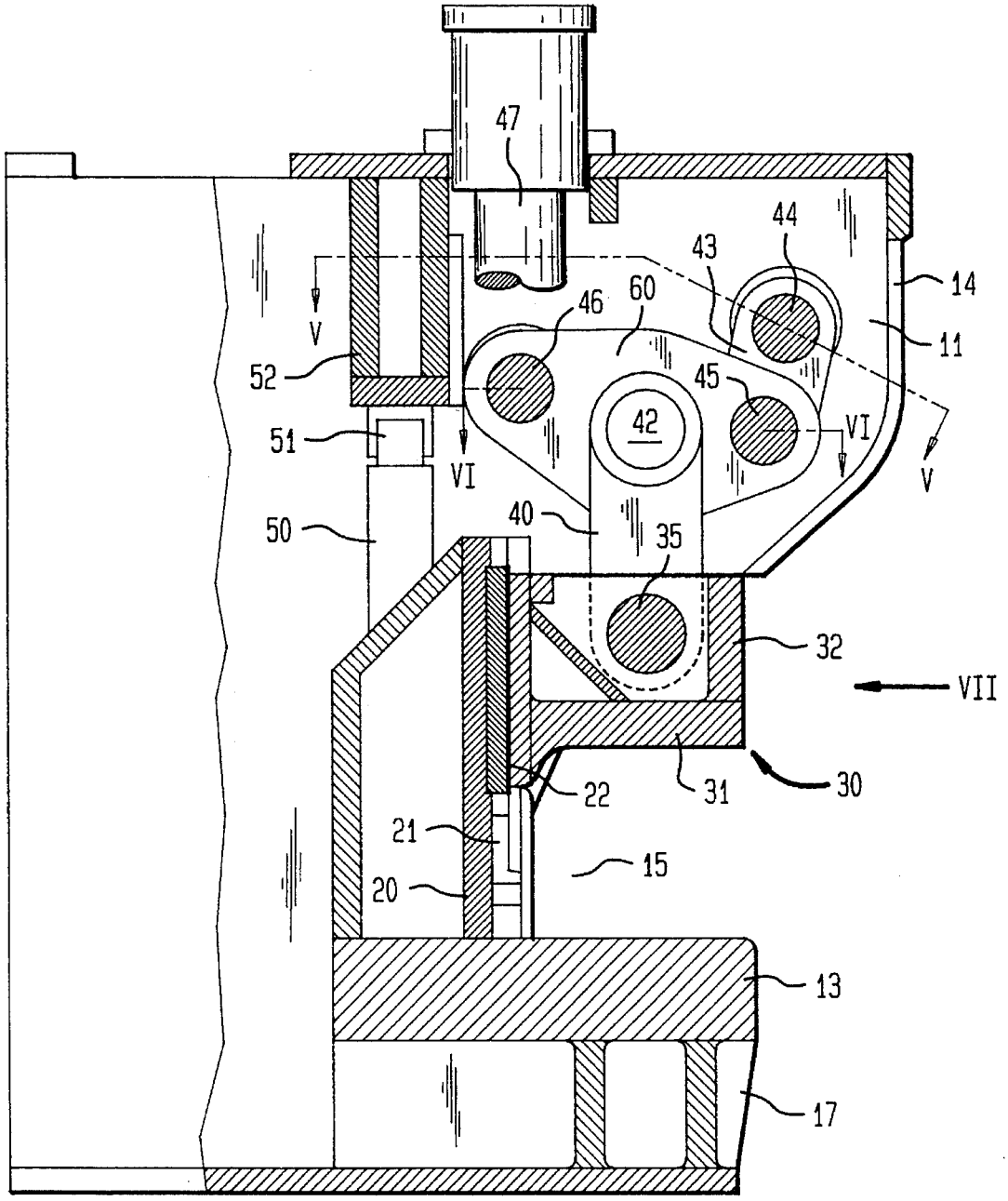
FIG. 4 shows a vertical section according to IV—IV of FIG. 2.
Figure 7:
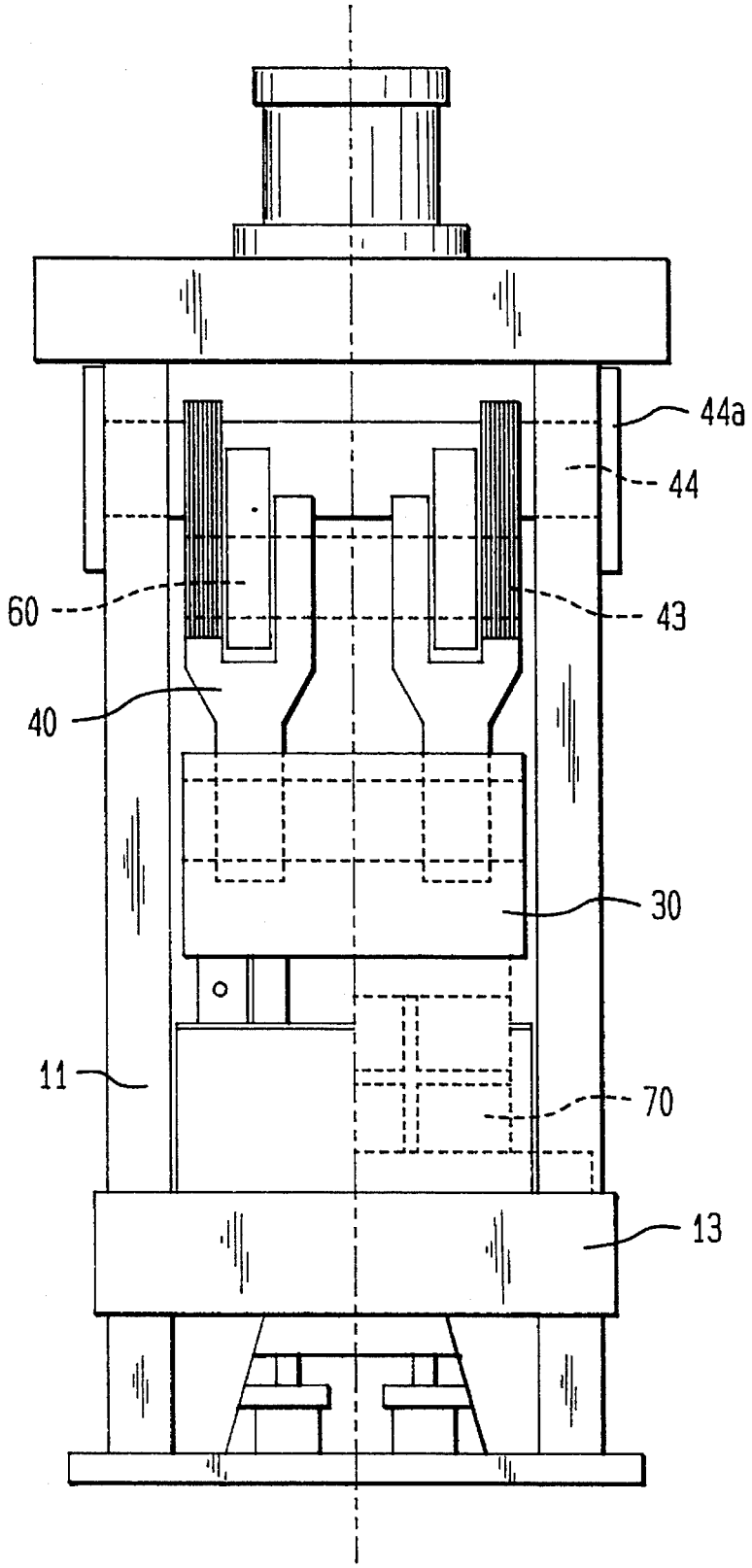
FIG. 7 shows a view according to VII of FIG. 4.

The design of the box-shaped slide as support of the pressing tool or die can be seen from FIGS. 3 and 4. A lower plate 31, a front plate 32 and side walls 33 and intermediate walls 34 are provided. A guiding body 20 is provided rigidly on the table 13 for guiding the reciprocating slide. The guide body 20 has two guideways 21, namely two lateral guideways **21*a*, and a central guideway 21*b* at which the slide is guided by means of a carriage 22. The guiding body 20 has a guiding function only. It remains free of the forces producing the many deformations during pressing processes on conventional press columns with conventional guideways and preventing precise guidance. A die is designated by 70 on the right-hand side in FIG. 7**.

As shown in FIG. 3, an axle 35 at which two identical lower guide rods 40 (connecting rods) are held in a vertical arrangement is supported in the slide 30, namely in the side walls 33 and in the intermediate wall 34. Each of these lower guide rods has a fork 41 at the top and receives therein a driving lever 60 in a basically horizontal position. The connection between the fork and the driving lever is produced in the center of same by means of an axle pin 42.

Figure 5:
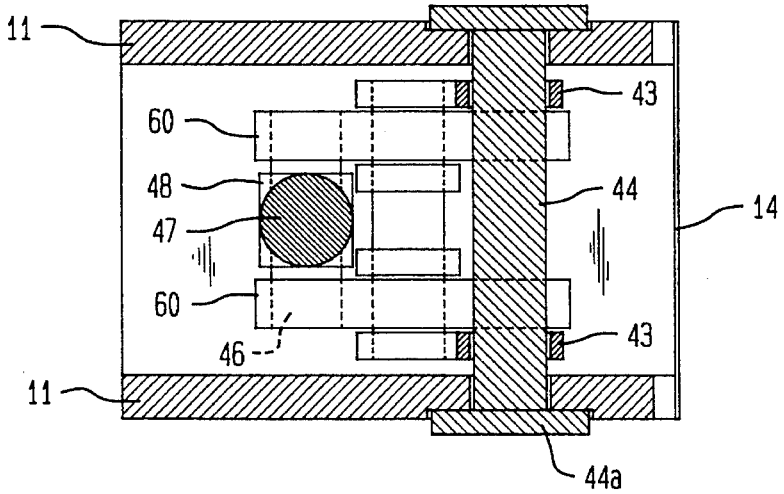
FIG. 5 shows a detail in section according to V—V of FIG. 4.

The two driving levers 60 are connected by one end in an articulated manner to a head 48 by means of an axle pin 46 (FIG. 5), this head being connected to a piston rod 47 of the pressure-medium cylinder 16. The two driving levers 60 are guided vertically in the region of the axle pin 46 during the reciprocating movement of the piston rod 47 and head 48.

Figure 6:
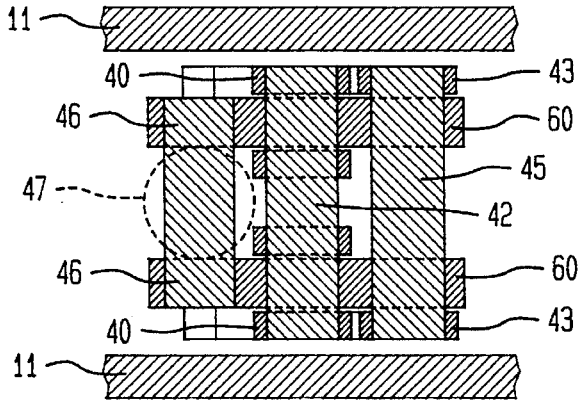
FIG. 6 shows a section according to VI—VI of FIG. 4.

The other ends of the driving levers 60 are connected by a lower shaft 45 (FIG. 6). Two upper guide rods 43 (FIG. 6), each of which is associated with a driving lever, are supported on this shaft. These upper guide rods are directed upward (FIG. 4) proceeding from the driving levers and are articulated at an upper shaft 44 which (FIG. 5) is supported in the side walls 11 by flanges 44*a*.

In the arrangement according to FIGS. 3 and 4, a column is associated with each column cheek 12 for damping. Each column has a lower part 50 which is rigidly connected with the base plate 10 and an upper part 52 which is rigidly connected with the head plate 12. Between these two structural component parts is arranged a hydraulic element 51 (pressure-medium element) whose cylinder is connected with the upper part and whose piston is connected with the lower part.

I claim:

1. An articulated lever press, comprising:

a frame having a base plate (10), two side walls (11), a head plate (12), and a table (13) supported on the base plate;

a box-shaped slide (30);

a pressure-medium cylinder (16) centrally arranged on the head plate and having a piston rod (47) terminating in a head portion (48);

an articulated lever system interconnecting the slide (30) and the piston rod (47) for moving the slide (30) up and down in direction of the table, said articulated lever system comprising two lower guide rods (40), each having one end in form of a fork and articulated at the slide (30) in a vertical arrangement, and a driving lever (60) received by the fork (41) of each guide rod, said driving levers having one end articulated to the head portion (48) of the piston rod (47) and another end being connected together by a lower shaft (45) which is secured to the side walls (11) via upper guide rods (43).

2. The articulated lever press of claim 1, further comprising cushioning means for absorbing shocks between the head plate and the table, said cushioning means including a column extending at each side wall and having a lower part (50) which is rigidly connected with the base plate (10) and an upper part (52) which is rigidly connected with the head plate (12), and a piston/cylinder unit extending between the head plate and the table and having a cylinder connected to one part of the column and a piston being connected with the other part of the column.

3. The articulated lever press of claim 1, further comprising a guiding body (20) arranged between the two side walls (11) for guiding the slide (30) and forming a unit with the press table (13) without connection with the side walls loaded by the pressing force.

4. An articulated lever press, comprising:

a frame having a table for receiving a workpiece;

a ram for applying pressure onto the workpiece;

force-generating means for applying pressure to descend the ram in direction of the table and the workpiece; and a linkage means interconnecting the ram and the force-generating means for transmitting the force from the force-generating means to the ram, said linkage means comprising a first lever arrangement in form of two vertical guide rods which are secured to the ram and have one end in form of a fork, and a second lever arrangement in form of two driving levers, respectively received by the fork of the guide rods, said driving levers having one end secured to the force-generating means and another end being connected together by a shaft which is secured to the frame via interposed guide rods.

5. The articulated lever press of claim 4 wherein the frame is formed by a base plate, two side walls and a head plate, with the table being supported on the base plate, and further comprising cushioning means for absorbing shocks between the head plate and the table, said cushioning means including a column extending at each side wall and having a lower part which is rigidly connected with the base plate and an upper part which is rigidly connected with the head plate, and a piston/cylinder unit extending between the head plate and the table and having a cylinder connected to one part of the column and a piston being connected with the other part of the column.

6. The articulated lever press of claim 4 wherein the frame is formed by a base plate, two side walls and a head plate, with the table being supported on the base plate, and further comprising a guiding body arranged between the two side walls for guiding the ram and forming a unit with the table without connection with the side walls loaded by the pressing force.

* * * * *